US011867421B2

(12) United States Patent
Yang et al.

(10) Patent No.: US 11,867,421 B2
(45) Date of Patent: Jan. 9, 2024

(54) AIR CONDITIONER AND CONTROL METHOD THEREFOR

(71) Applicants: Qingdao Haier Air-conditioning Electronic Co., Ltd, Shandong (CN); Haier Smart Home Co., Ltd., Shandong (CN)

(72) Inventors: Kun Yang, Qingdao (CN); Yabin Sui, Qingdao (CN); Yanyao Lei, Qingdao (CN); Yunhua Ma, Qingdao (CN); Junhui Zhang, Qingdao (CN); Zongke Wei, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 319 days.

(21) Appl. No.: 17/290,842

(22) PCT Filed: Oct. 21, 2019

(86) PCT No.: PCT/CN2019/112230
§ 371 (c)(1),
(2) Date: May 3, 2021

(87) PCT Pub. No.: WO2020/134404
PCT Pub. Date: Jul. 2, 2020

(65) Prior Publication Data

US 2021/0389012 A1 Dec. 16, 2021

(30) Foreign Application Priority Data

Dec. 29, 2018 (CN) ..... 201811636115.4

(51) Int. Cl.
*F24F 11/64* (2018.01)
*F24F 11/38* (2018.01)

(52) U.S. Cl.
CPC ..... *F24F 11/64* (2018.01); *F24F 11/38* (2018.01)

(58) Field of Classification Search
CPC ..... F24F 11/64; F24F 11/38
See application file for complete search history.

(56) References Cited

U.S. PATENT DOCUMENTS 4,232,530 A * 11/1980 Mueller ..... F25B 49/022 62/126
4,301,660 A * 11/1981 Mueller ..... F25B 49/02 62/126

(Continued)

FOREIGN PATENT DOCUMENTS

CN 2013204935 A 10/2013
CN 104729023 A 6/2015

(Continued)

OTHER PUBLICATIONS

International Search Report dated Jan. 15, 2020 in corresponding International Application No. PCT/CN2019/112230; 5 pages.

*Primary Examiner* — Nelson J Nieves
(74) *Attorney, Agent, or Firm* — Maier & Maier, PLLC

(57) ABSTRACT

An air conditioner and control method therefor to solve the problem that an existing air conditioner stops operation upon detection of an operation parameter abnormality situation, causing the user experience to be significantly influenced. For this reason, the air conditioner includes a compressor. The control method includes: obtaining an outdoor ambient temperature; determining a first preset time period according to the outdoor ambient temperature; obtaining operation parameters of the compressor after the first preset time period; and selectively stopping operation of the air conditioner according to the operation parameters of the compressor, so that the air conditioner can be automatically repaired within the first preset time period. If the air con- (Continued)

ditioner can be automatically repaired within the first preset time period, the air conditioner does not need to stop operation, so as to guarantee a continuous heat exchange capability of the air conditioner and not to cause an operation failure.

7 Claims, 2 Drawing Sheets

(56) References Cited

U.S. PATENT DOCUMENTS

| | | | | |
|---|---|---|---|---|
| 2015/0168042 | A1* | 6/2015 | Goel | F25B 49/022 62/126 |
| 2018/0347863 | A1* | 12/2018 | Tamaoki | F25B 49/025 |
| 2019/0120533 | A1* | 4/2019 | Lee | F25D 29/00 |
| 2019/0128554 | A1* | 5/2019 | Popli | F24F 11/65 |
| 2019/0338994 | A1* | 11/2019 | Zhang | F24F 11/63 |
| 2020/0300530 | A1* | 9/2020 | Kim | F25D 17/067 |
| 2020/0318882 | A1* | 10/2020 | Lee | F25D 17/065 |
| 2021/0222900 | A1* | 7/2021 | Liu | F24F 11/63 |
| 2021/0333031 | A1* | 10/2021 | Micallef | F25B 1/00 |
| 2021/0348789 | A1* | 11/2021 | Fukui | F24F 11/67 |

FOREIGN PATENT DOCUMENTS

| | | | | |
|---|---|---|---|---|
| CN | 105066377 | A | * 11/2015 | |
| CN | 105509255 | A | 4/2016 | |
| CN | 105546753 | A | 5/2016 | |
| CN | 205208775 | U | 5/2016 | |
| CN | 105737424 | A | 7/2016 | |
| CN | 106016606 | A | * 10/2016 | F24F 11/30 |
| CN | 106123417 | A | * 11/2016 | F24F 13/24 |
| CN | 108518815 | A | * 9/2018 | |
| CN | 109737566 | A | 5/2019 | |

* cited by examiner

AIR CONDITIONER AND CONTROL METHOD THEREFOR

FIELD

The present disclosure belongs to the technical field of air conditioners, and specifically relates to an air conditioner and a control method therefor.

BACKGROUND

With the continuous improvement of people's living standards, people have also raised higher and higher requirements on the living environment. In order to maintain a comfortable ambient temperature, the air conditioner has become an indispensable device in people's lives. In recent years, in order to further improve the safety performance of air conditioners, technicians have equipped almost all the air conditioners with self-detection functions, and existing air conditioners usually have many ways of self-detection; as a common way of self-detection, existing air conditioners judge the operating condition thereof by detecting some operating parameter values, thereby selectively stopping the operation of the air conditioners.

Specifically, when an existing air conditioner detects that some operating parameter values of its own exceed a preset range, it will immediately stop operating; although this control method is more advantageous for the protection of the air conditioner, it does not take into account the user experience very well. It can be understood that when the ambient temperature is too low or too high and the air conditioner is just turned on and operating, many operating parameters of the air conditioner will exceed the preset range; at this moment, the existing air conditioners will be forcibly stopped from operating; however, in most cases, these operating parameters can automatically return to normal as long as the air conditioners are forced to operate normally for a period of time, so that all the operating parameters of the air conditioners can return to normal.

Accordingly, there is a need for a new air conditioner and a control method therefor in the art to solve the above problems.

SUMMARY

In order to solve the above problem in the prior art, that is, in order to solve the problem that once the existing air conditioner detects an abnormality of operating parameters, it will immediately stop operating, which will have a severe influence on the user experience, the present disclosure provides a control method for an air conditioner, the air conditioner including a compressor, and the control method including: acquiring an outdoor ambient temperature; determining a first preset time according to the outdoor ambient temperature; acquiring operating parameters of the compressor after the first preset time has elapsed; and selectively stopping the operation of the air conditioner according to the operating parameters of the compressor.

In a preferred technical solution of the above control method for an air conditioner, the step of "acquiring operating parameters of the compressor after the first preset time has elapsed" specifically includes: acquiring a discharge temperature of the compressor after the first preset time has elapsed; and the step of "selectively stopping the operation of the air conditioner according to the operating parameters of the compressor" specifically includes: selectively stopping the operation of the air conditioner according to the discharge temperature of the compressor.

In a preferred technical solution of the above control method for an air conditioner, when the air conditioner is in a heating mode, the step of "selectively stopping the operation of the air conditioner according to the discharge temperature of the compressor" specifically includes: stopping the operation of the air conditioner if the discharge temperature of the compressor is lower than a preset temperature.

In a preferred technical solution of the above control method for an air conditioner, when the air conditioner is in the heating mode, the step of "selectively stopping the operation of the air conditioner according to the discharge temperature of the compressor" specifically includes—making the air conditioner continue operating, if the discharge temperature of the compressor is higher than or equal to the preset temperature.

In a preferred technical solution of the above control method for an air conditioner, in a case where the air conditioner is made continue operating, the control method further includes: determining a second preset time according to the outdoor ambient temperature; acquiring a low-magnitude pressure of the compressor after the second preset time has elapsed; and selectively stopping the operation of the air conditioner according to the low-magnitude pressure of the compressor.

In a preferred technical solution of the above control method for an air conditioner, when the air conditioner is in a heating mode, the step of "selectively stopping the operation of the air conditioner according to the low-magnitude pressure of the compressor" specifically includes: stopping the operation of the air conditioner if the low-magnitude pressure of the compressor is smaller than a preset pressure.

In a preferred technical solution of the above control method for an air conditioner, when the air conditioner is in a heating mode, the step of "selectively stopping the operation of the air conditioner according to the low-magnitude pressure of the compressor" specifically includes—making the air conditioner continue operating, if the low-magnitude pressure of the compressor is higher than or equal to the preset pressure.

In a preferred technical solution of the above control method for an air conditioner, when the air conditioner is in a heating mode, the step of "determining the first preset time according to the outdoor ambient temperature" specifically includes: determining that the first preset time is 3 minutes, if the outdoor ambient temperature is higher than −10° C.; and determining that the first preset time is 10 minutes, if the outdoor ambient temperature is higher than or equal to −25° C. and lower than or equal to −10° C.

In a preferred technical solution of the above control method for an air conditioner, when the air conditioner is in a heating mode, the step of "determining the second preset time according to the outdoor ambient temperature" specifically includes: determining that the second preset time is 6 minutes, if the outdoor ambient temperature is higher than −10° C.; and determining that the second preset time is 15 minutes, if the outdoor ambient temperature is higher than or equal to −25° C. and lower than or equal to −10° C.

The present disclosure also provides an air conditioner which includes a controller, and the controller is capable of executing the control method described in any one of the above preferred technical solutions.

It can be understood by those skilled in the art that in the preferred technical solutions of the present disclosure, the air conditioner of the present disclosure includes a compressor, and the control method of the present disclosure includes: acquiring an outdoor ambient temperature; determining a first preset time according to the outdoor ambient temperature; acquiring operating parameters of the compressor after the first preset time has elapsed; and selectively stopping the operation of the air conditioner according to the operating parameters of the compressor. The present disclosure determines the corresponding first preset time according to different outdoor ambient temperatures, that is, the air conditioner can judge whether the outdoor ambient temperature is too high or too low based on the value of the outdoor ambient temperature, so as to judge whether there are abnormal operating parameters in the air conditioner due to the outdoor ambient temperature being too high or too low; that is, when the air conditioner judges that the outdoor ambient temperature is too high or too low, the air conditioner will not immediately stop operating due to the abnormal operating parameters of the compressor; rather, the air conditioner operates normally for the first preset time, after which the operating parameters of the compressor are acquired, and the operation of the air conditioner is selectively stopped according to the operating parameters of the compressor; moreover, the air conditioner can also determine different first preset times according to different outdoor ambient temperatures, so as to adapt to different operating conditions. Further, if all the operating parameters of the air conditioner are within a normal range after the first preset time has elapsed, it indicates that the air conditioner can correct abnormal operating parameters through normal operation, that is, it is not necessary to stop the operation of the air conditioner, so as to ensure that the air conditioner can continue exchanging heat in some cases without being initially affected by the ambient temperature to cause inability to operate, thereby ensuring the heat exchange capacity of the air conditioner to the greatest extent, and further effectively improving the user experience; and if the operating parameters of the air conditioner are abnormal after the first preset time has elapsed, it indicates that the air conditioner does have a fault that cannot be automatically repaired. In this case, the air conditioner stops operating so as to effectively protect the air conditioner from further damage.

Further, as a preferred technical solution of the present disclosure, after the first preset time has elapsed, the discharge temperature of the compressor is acquired; then the air conditioner is selectively made stop operating according to the discharge temperature of the compressor; that is, the air conditioner can judge the operating condition of the compressor according to the discharge temperature of the compressor after operating for the first preset time, and then the operating condition of the air conditioner can be judged. Therefore, the air conditioner is selectively stopped from operating according to the discharge temperature of the compressor, so that the air conditioner can also be effectively protected while meeting the user's requirements on use.

Further, as a preferred technical solution of the present disclosure, when the air conditioner is in the heating mode, if the discharge temperature of the compressor is lower than the preset temperature, it indicates that the discharging of the compressor is still abnormal after the air conditioner has operated for the first preset time, that is, the discharge temperature of the compressor is abnormal and cannot be automatically repaired. At this time, the air conditioner is made stop operating, so as to effectively protect the air conditioner; at the same time, if the discharge temperature of the compressor is higher than or equal to the preset temperature, it indicates that the discharging condition of the compressor is repaired after the controller has operated for the first preset time. At this time, the air conditioner is made continue operating, so as to effectively meet the heat exchange demand of users. In addition, preferably, the preset temperature is 0° C.

Furthermore, as a preferred technical solution of the present disclosure, when the air conditioner is in the operating state, the control method further includes: determining a second preset time according to the outdoor ambient temperature; acquiring a low-magnitude pressure of the compressor after the second preset time has elapsed; and selectively stopping the operation of the air conditioner according to the low-magnitude pressure of the compressor. That is, in a case where the discharging condition of the compressor returns to normal, the air conditioner can also acquire the low-magnitude pressure of the compressor after operating for the second preset time, then the operating condition of the compressor can be judged according to the low-magnitude pressure of the compressor, and further the operating condition of the air conditioner can be judged, thereby selectively stopping the operation of the air conditioner according to the low-magnitude pressure of the compressor, so that the air conditioner can also be effectively protected while meeting the user's requirements on use.

Furthermore, as a preferred technical solution of the present disclosure, when the air conditioner is in the heating mode, if the low-magnitude pressure of the compressor is lower than the preset pressure, it indicates that the discharging of the compressor is still abnormal after the air conditioner has operated for the second preset time, that is, the low-magnitude pressure of the compressor is abnormal and cannot be automatically repaired. At this time, the air conditioner is made stop operating, so as to effectively protect the air conditioner; at the same time, if the discharge temperature of the compressor is higher than or equal to the preset temperature, it indicates that the discharging condition of the compressor has been repaired after the controller has operated for the first preset time. At this time, the air conditioner is made continue operating, so as to effectively meet the heat exchange demand of users. In addition, preferably, the low-magnitude pressure is 0.05 MPa.

It can be understood by those skilled in the art that during the operation of the air conditioner, the repairing speeds of various operating parameters of the compressor are different. Therefore, in the preferred technical solution of the present disclosure, the present disclosure can determine two preset times according to the outdoor ambient temperature to correspond to two different operating parameters, so as to adapt to the time required for the compressor to repair the different operating parameters. In addition, it should be noted that since the repairing speed of the discharge temperature is usually faster than the repairing speed of the low-magnitude pressure, after the first preset time has elapsed, the discharge temperature of the compressor is firstly used to judge the operating condition of the air conditioner, and the air conditioner is selectively made stop operating; if the air conditioner is still in the operating state, then after the second preset time has elapsed, the operating condition of the air conditioner is judged according to the low-magnitude pressure of the compressor, so as to selectively stop the operation of the air conditioner.

Further, as a preferred technical solution of the present disclosure, the control method can determine the corresponding first preset time and the corresponding second preset time according to different outdoor ambient temperatures, so as to adapt to different operating conditions of the air conditioner. In a case where the air conditioner is in the heating mode, when the outdoor ambient temperature is higher than −10° C., the first preset time is preferably 3 minutes, and the second preset time is preferably 6 minutes; in addition, when the outdoor ambient temperature is higher than or equal to −25° C. and lower than or equal to −10° C., the first preset time is preferably 10 minutes, and the second preset time is preferably 15 minutes.

DETAILED DESCRIPTION OF THE EMBODIMENTS

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure. For example, although the various steps of the method of the present disclosure are described in a specific order in this application, these orders are not limitative, and those skilled in the art can execute these described steps in a different order without departing from the basic principles of the present disclosure.

First, it should be noted that in the preferred embodiment, the air conditioner includes an outdoor temperature sensor and a discharge temperature sensor, wherein the outdoor temperature sensor can measure an outdoor ambient temperature, and the discharge temperature sensor can measure a discharge temperature of the compressor; of course, the present disclosure does not impose any restrictions on specific installation positions and specific types of the outdoor temperature sensor and the discharge temperature sensor, and technicians can make the selection by themselves according to actual requirements on use. At the same time, the air conditioner also includes a pressure gauge, which can measure a low-magnitude pressure of the compressor. Of course, the present disclosure also does not impose any restrictions on specific installation position and specific type of the pressure gauge, and technicians can make the selection by themselves according to actual requirements on use. In addition, the air conditioner further includes a controller that can acquire measurement data of the outdoor temperature sensor, the discharge temperature sensor and the pressure gauge, and the controller can also control the operation of the air conditioner. It can be understood by those skilled in the art that the present disclosure does not impose any restrictions on the specific structure and model of the controller, and the controller may be the original controller of the air conditioner, or it may be a controller separately provided to implement the control method of the present disclosure.

Figure 1:
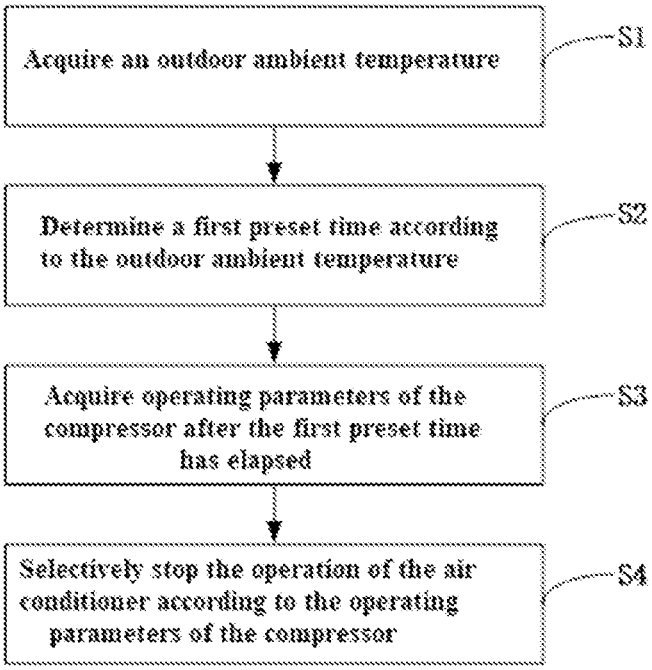
FIG. 1 is a flowchart showing main steps of the control method of the present disclosure.

Next, reference is made to FIG. 1, which is a flowchart showing main steps of the control method of the present disclosure. As shown in FIG. 1, based on the air conditioner described in the above embodiment, the control method of the present disclosure mainly includes the following steps:

S1: acquiring an outdoor ambient temperature;

S2: determining a first preset time according to the outdoor ambient temperature;

S3: acquiring operating parameters of the compressor after the first preset time has elapsed; and S4: selectively stopping the operation of the air conditioner according to the operating parameters of the compressor.

Further, in step S1, the controller can acquire the outdoor ambient temperature through the outdoor temperature sensor; it should be noted that the present disclosure does not impose any restrictions on the way in which the outdoor ambient temperature is acquired by the controller. The controller can either acquire the outdoor ambient temperature through a temperature sensor provided by the air conditioner itself, or acquire the outdoor ambient temperature in a cloud through networking. Next, in step S2, the controller can determine the first preset time according to the outdoor ambient temperature; it can be understood by those skilled in the art that the present disclosure does not impose any restrictions on the correspondence between the outdoor ambient temperature and the first preset time, and technicians can set the specific correspondence between the outdoor ambient temperature and the first preset time by themselves according to actual requirements on use.

Furthermore, in step S3, after the first preset time has elapsed, the controller can acquire the operating parameters of the compressor; it should be noted that the present disclosure does not impose any restrictions on the types of the operating parameters acquired by the controller and the way of acquiring them, as long as the operating parameters can reflect the operating condition of the compressor. For example, the operating parameters may be one or more of discharge temperature, suction pressure and evaporation pressure. Finally, in step S4, the controller can selectively stop the operation of the air conditioner according to the operating parameters of the compressor; generally, when the operating parameters of the compressor exceed a normal range, the controller will stop the operation of the air conditioner. Of course, this description is not restrictive. Technicians may set the judgment condition for the controller to control the air conditioner to stop operating by themselves according to actual requirements on use. The change of the judgment condition does not deviate from the basic principles of the present disclosure, and falls within the scope of protection of the present disclosure.

Figure 2:
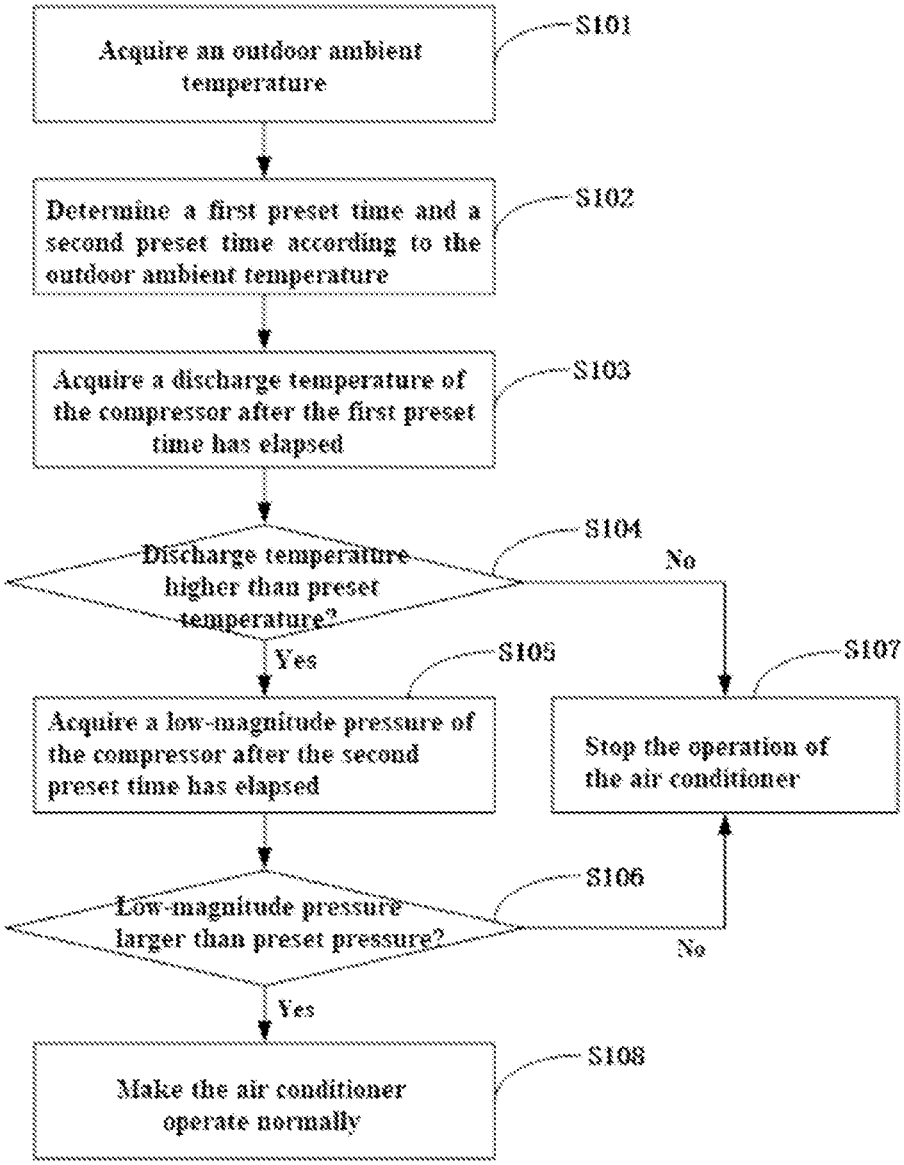
FIG. 2 is a flowchart showing specific steps of a preferred embodiment of the control method of the present disclosure.

Next, reference is made to FIG. 2, which is a flowchart showing specific steps of a preferred embodiment of the control method of the present disclosure. As shown in FIG. 2, based on the air conditioner described in the above embodiment, when the air conditioner is in a heating mode, a preferred embodiment of the control method of the present disclosure specifically includes the following steps:

S101: acquiring an outdoor ambient temperature;

S102: determining a first preset time and a second preset time according to the outdoor ambient temperature;

S103: acquiring a discharge temperature of the compressor after the first preset time has elapsed;

S104: judging whether the discharge temperature is higher than or equal to a preset temperature; if yes, executing step S105; and if not, executing step S107;

S105: acquiring a low-magnitude pressure of the compressor after the second preset time has elapsed;

S106: judging whether the low-magnitude pressure is larger than or equal to a preset pressure; if yes, executing step S108; and if not, executing step S107;

S107: stopping the operation of the air conditioner; and

S108: making the air conditioner operate normally.

Further, in step S101, after the air conditioner is turned on and operating, the controller can acquire the outdoor ambient temperature through the outdoor temperature sensor; it should be noted that the present disclosure does not impose any restrictions on the way in which the outdoor ambient temperature is acquired by the controller. The controller can either acquire the outdoor ambient temperature through the temperature sensor provided by the air conditioner itself, or acquire the outdoor ambient temperature in a cloud through networking. Next, in step S102, the controller can determine the first preset time and the second preset time according to the outdoor ambient temperature; it should be noted that the present disclosure does not impose any restrictions on the correspondence between the outdoor ambient temperature and the first preset time as well as the correspondence between the outdoor ambient temperature and the second preset time, and technicians can set the specific correspondence between the outdoor ambient temperature and the first preset time as well as the specific correspondence between the outdoor ambient temperature and the second preset time by themselves according to actual requirements on use. In addition, it can be understood by those skilled in the art that although the second preset time is determined in step S102 in the present preferred embodiment, it is obvious that the second preset time may also be determined in subsequent steps, as long as the second preset time is determined before step S105.

It should be noted that, preferably, in a case where the air conditioner is in the heating mode, when the outdoor ambient temperature is higher than −10° C., the first preset time is preferably 3 minutes, and the second preset time is preferably 6 minutes; in addition, when the outdoor ambient temperature is higher than or equal to −25° C. and lower than or equal to −10° C., the first preset time is preferably 10 minutes, and the second preset time is preferably 15 minutes. Herein, both the first preset time and the second preset time as mentioned are a time period calculated from the same starting point, and endpoint values in each temperature interval may also be allocated to different intervals as needed. At the same time, it can be understood by those skilled in the art that this setting relationship is only a preferred setting, and is not exemplary. Obviously, technicians can set the specific correspondence between the outdoor ambient temperature and the first preset time as well as the specific correspondence between the outdoor ambient temperature and the second preset time by themselves according to actual situation.

Further, in step S103, after the first preset time has elapsed, the controller can acquire the discharge temperature of the compressor through the discharge temperature sensor; it should be noted that the present disclosure does not impose any restrictions on the way in which the discharge temperature of the compressor is acquired by the controller, as long as the controller can acquire the discharge temperature. Next, in step S104, the controller can judge whether the discharge temperature is higher than or equal to the preset temperature; preferably, the preset temperature is 0° C. If the discharge temperature of the compressor is lower than the preset temperature, it indicates that the compressor still has the problem of abnormal discharging; at this time, step S107 is executed, that is, the air conditioner is made stop operating, so as to protect the air conditioner. If the discharge temperature of the compressor is higher than or equal to the preset temperature, it indicates that the controller still needs to further judge the operating condition of the compressor based on the low-magnitude pressure of the compressor; at this time, step S106 is executed in order to make a further judgment. In addition, it can be understood by those skilled in the art that technicians may set the preset temperature by themselves according to actual use conditions, as long as the preset temperature can reflect whether the operating condition of the air conditioner is normal.

Further, in step S105, after the second preset time has elapsed, the controller can acquire the low-magnitude pressure of the compressor through the pressure gauge; it should be noted that the present disclosure does not impose any restrictions on the way in which the low-magnitude pressure of the compressor is acquired by the controller, as long as the controller can acquire the low-magnitude pressure; at the same time, technicians can use a suction pressure to represent the low-magnitude pressure or use an evaporation pressure to represent the low-magnitude pressure. Next, in step S106, the controller can judge whether the low-magnitude pressure is larger than or equal to the preset pressure; preferably, the preset pressure is 0.05 MPa. If the low-magnitude pressure of the compressor is smaller than the preset pressure, it indicates that the compressor still has the problem of abnormal suctioning; at this time, step S107 needs to be executed, that is, the air conditioner is made stop operating, so as to protect the air conditioner. If the low-magnitude pressure of the compressor is larger than or equal to the preset pressure, it indicates that the compressor is in a normal operating state. At this time, step S108 is executed, that is, the air conditioner is made operate normally, so as to ensure the heat exchange demand of users. In addition, it can be understood by those skilled in the art that technicians may set the preset pressure by themselves according to the actual use conditions, as long as the preset pressure can reflect whether the operating condition of the air conditioner is normal.

In addition, it should also be noted that although the preferred embodiment is described in conjunction with a situation in which the air conditioner is in the heating mode, it is obvious that the control method of the present disclosure can also be used in a cooling mode. In a case where the air conditioner is in the cooling mode, technicians only need to reset the set values of the preset temperature and the preset pressure, reset the specific correspondence between the outdoor ambient temperature and the first preset time as well as the specific correspondence between the outdoor ambient temperature and the second preset time, and then reset the judgment condition for stopping the operation of the air conditioner.

Finally, it should be noted that the above embodiments are all preferred implementations of the present disclosure, and they are not intended to limit the scope of protection of the present disclosure. When practicing the present disclosure in actual use, those skilled in the art can appropriately add or delete a part of the steps as needed, or exchange the order between different steps. Such changes do not go beyond the basic principles of the present disclosure, and belong to the scope of protection of the present disclosure.

Hitherto, the preferred implementations of the present disclosure have been described in conjunction with the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A control method for an air conditioner, the air conditioner comprising a compressor, and the control method comprising:

acquiring an outdoor ambient temperature;

determining a first preset time according to the outdoor ambient temperature;

acquiring operating parameters of the compressor after the first preset time has elapsed; and selectively stopping an operation of the air conditioner according to the operating parameters of the compressor;

wherein the acquiring operating parameters of the compressor after the first preset time has elapsed comprises acquiring a discharge temperature of the compressor after the first preset time has elapsed;

wherein the selectively stopping the operation of the air conditioner according to the operating parameters of the compressor comprises selectively stopping the operation of the air conditioner according to the discharge temperature of the compressor; and wherein, in a case where the air conditioner is made to continue operating, the control method further comprises:

determining a second preset time according to the outdoor ambient temperature;

acquiring a low-magnitude pressure of the compressor after the second preset time has elapsed; and selectively stopping the operation of the air conditioner according to the low-magnitude pressure of the compressor.

2. The control method according to claim 1, wherein when the air conditioner is in a heating mode, the selectively stopping the operation of the air conditioner according to the discharge temperature of the compressor comprises:

stopping the operation of the air conditioner if the discharge temperature of the compressor is lower than a preset temperature.

3. The control method according to claim 2, wherein when the air conditioner is in the heating mode, the selectively stopping the operation of the air conditioner according to the discharge temperature of the compressor comprises:

making the air conditioner continue operating, if the discharge temperature of the compressor is higher than or equal to the preset temperature.

4. The control method according to claim 1, wherein when the air conditioner is in a heating mode, the selectively stopping the operation of the air conditioner according to the low-magnitude pressure of the compressor comprises:

stopping the operation of the air conditioner if the low-magnitude pressure of the compressor is smaller than a preset pressure.

5. The control method according to claim 1, wherein when the air conditioner is in a heating mode, the determining the first preset time according to the outdoor ambient temperature comprises:

determining that the first preset time is 3 minutes, if the outdoor ambient temperature is higher than −10° C.; and determining that the first preset time is 10 minutes, if the outdoor ambient temperature is higher than or equal to −25° C. and lower than or equal to −10° C.

6. The control method according to claim 1, wherein when the air conditioner is in a heating mode, the determining the second preset time according to the outdoor ambient temperature comprises:

determining that the second preset time is 6 minutes, if the outdoor ambient temperature is higher than −10° C.; and determining that the second preset time is 15 minutes, if the outdoor ambient temperature is higher than or equal to −25° C. and lower than or equal to −10° C.

7. An air conditioner, wherein the air conditioner comprises a controller, and the controller is capable of executing the control method according to claim 1.

* * * * *